US008147008B2

(12) United States Patent
Guebre-Tsadik et al.

(10) Patent No.: US 8,147,008 B2
(45) Date of Patent: Apr. 3, 2012

(54) INTERLOCK SYSTEM FOR MULTI-DOOR ENCLOSURES

(75) Inventors: Anteneh Guebre-Tsadik, Coon Rapids, MN (US); Joseph David Ricke, Arden Hills, MN (US); Jason Curtis Nygaard, New Hope, MN (US); Dean Jerome Bergerson, Brooklyn Park, MN (US); Steven Lyle Ruud, Anoka, MN (US)

(73) Assignee: Hoffman Enclosures, Inc., Anoka, MN (US)

( * ) Notice: Subject to any disclaimer, the term of this patent is extended or adjusted under 35 U.S.C. 154(b) by 404 days.

(21) Appl. No.: 10/886,919

(22) Filed: Jul. 8, 2004

(65) Prior Publication Data

US 2006/0006773 A1 Jan. 12, 2006

(51) Int. Cl.
*E05B 65/46* (2006.01)

(52) U.S. Cl. ..... 312/220; 312/216; 312/109

(58) Field of Classification Search ..... 312/326, 312/329, 109, 107.5, 220, 215, 216, 218; 49/103, 394, 395; 292/32, 38, 42, 146, 150, 292/DIG. 21; 70/265
See application file for complete search history.

(56) References Cited

U.S. PATENT DOCUMENTS

| | | | | |
|---|---|---|---|---|
| 2,259,722 | A * | 10/1941 | Bales | 312/109 |
| 2,320,849 | A * | 6/1943 | Claybourn et al. | 70/265 |
| 2,521,498 | A * | 9/1950 | Beymer et al. | 292/146 |
| 2,543,643 | A * | 2/1951 | Ryan et al. | 312/218 |
| 5,641,215 | A * | 6/1997 | Pochet | 312/109 |
| 5,944,397 | A | 8/1999 | Zeitler | 312/220 |
| 6,047,501 | A | 4/2000 | Zeitler | 49/506 |

* cited by examiner

*Primary Examiner* — James O Hansen
(74) *Attorney, Agent, or Firm* — Quarles & Brady LLP

(57) ABSTRACT

A multi-door enclosure includes an enclosure body, a primary door having an actuator and a secondary door. An interlock member having a holding section extends between the primary door and the secondary door. As the primary door closes, the actuator contacts the interlock member to translate the interlock member towards the secondary door until the holding section engages the secondary door.

8 Claims, 12 Drawing Sheets

INTERLOCK SYSTEM FOR MULTI-DOOR ENCLOSURES

FIELD OF THE INVENTION

This invention relates to the field of electrical enclosures, and more specifically to a method and apparatus for interlocking the doors of a multi-door enclosure.

BACKGROUND

Electrical enclosures can be used to house assorted electrical equipment. The enclosure protects the electrical equipment from the environment and helps prevent access to the equipment. Multi-door enclosures are enclosures with two or more doors. Multi-door enclosures include a primary or master door and one or more secondary or slave doors. In some applications, industry standards require that the secondary doors be unopenable unless the primary door is opened. To perform such a function, some multi-door enclosures include relatively complex and large mechanisms which disable the door handle latch mechanism of the secondary door when the primary door is closed and enable the handle latch mechanism of the secondary door when the primary door is open. A smaller and less complex system is needed for multi-door enclosures.

SUMMARY

In one aspect a multi-door enclosure includes an enclosure body, a primary door having an actuator and a secondary door. An interlock member having a holding section extends between the primary door and the secondary door. As the primary door closes, the actuator contacts the interlock member to translate the interlock member towards the secondary door until the holding section engages the secondary door to prevent the secondary door from being opened.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1A:
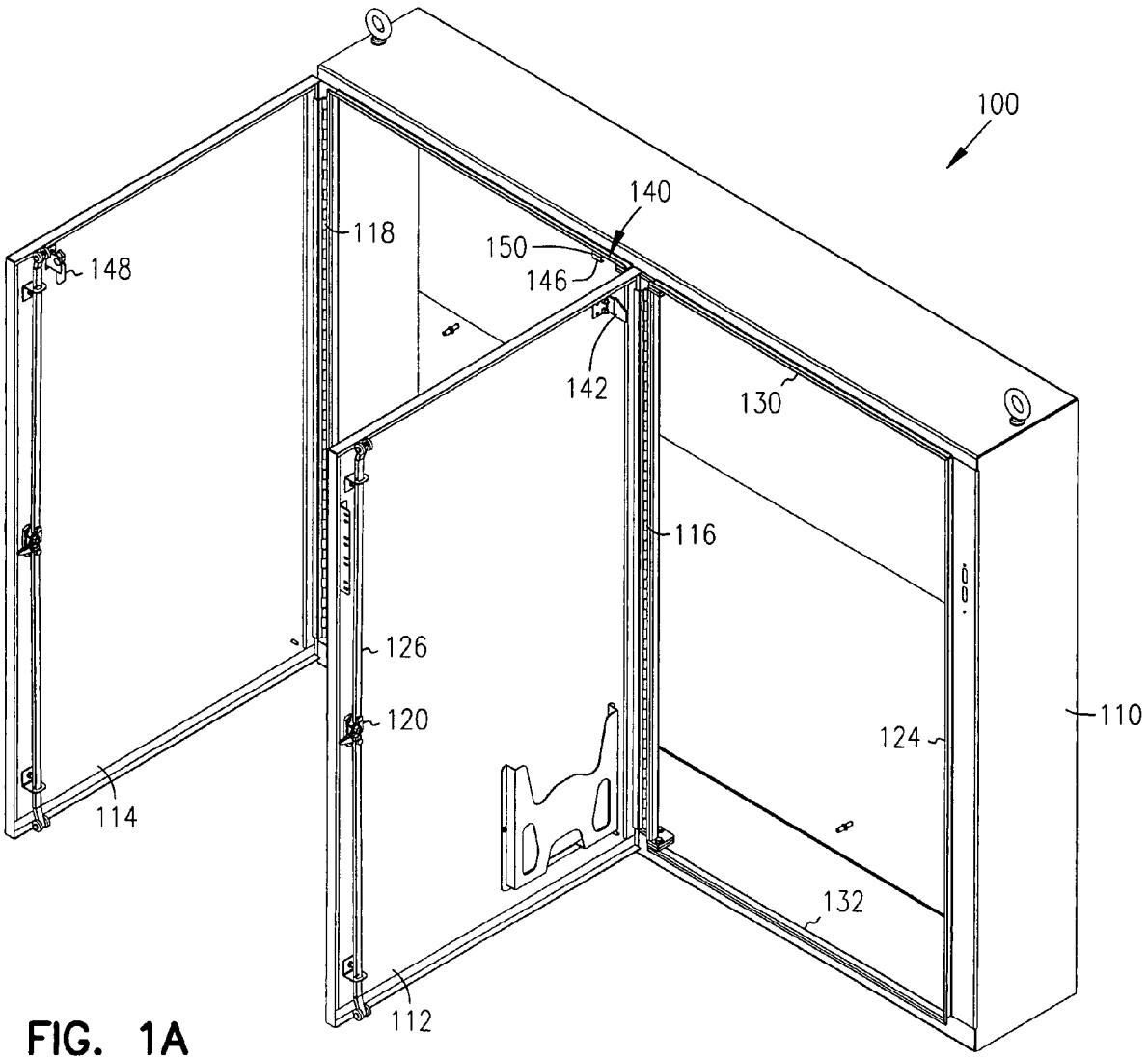
FIG. 1A shows a perspective view of a multi-door enclosure according to one embodiment.
Figure 1B:
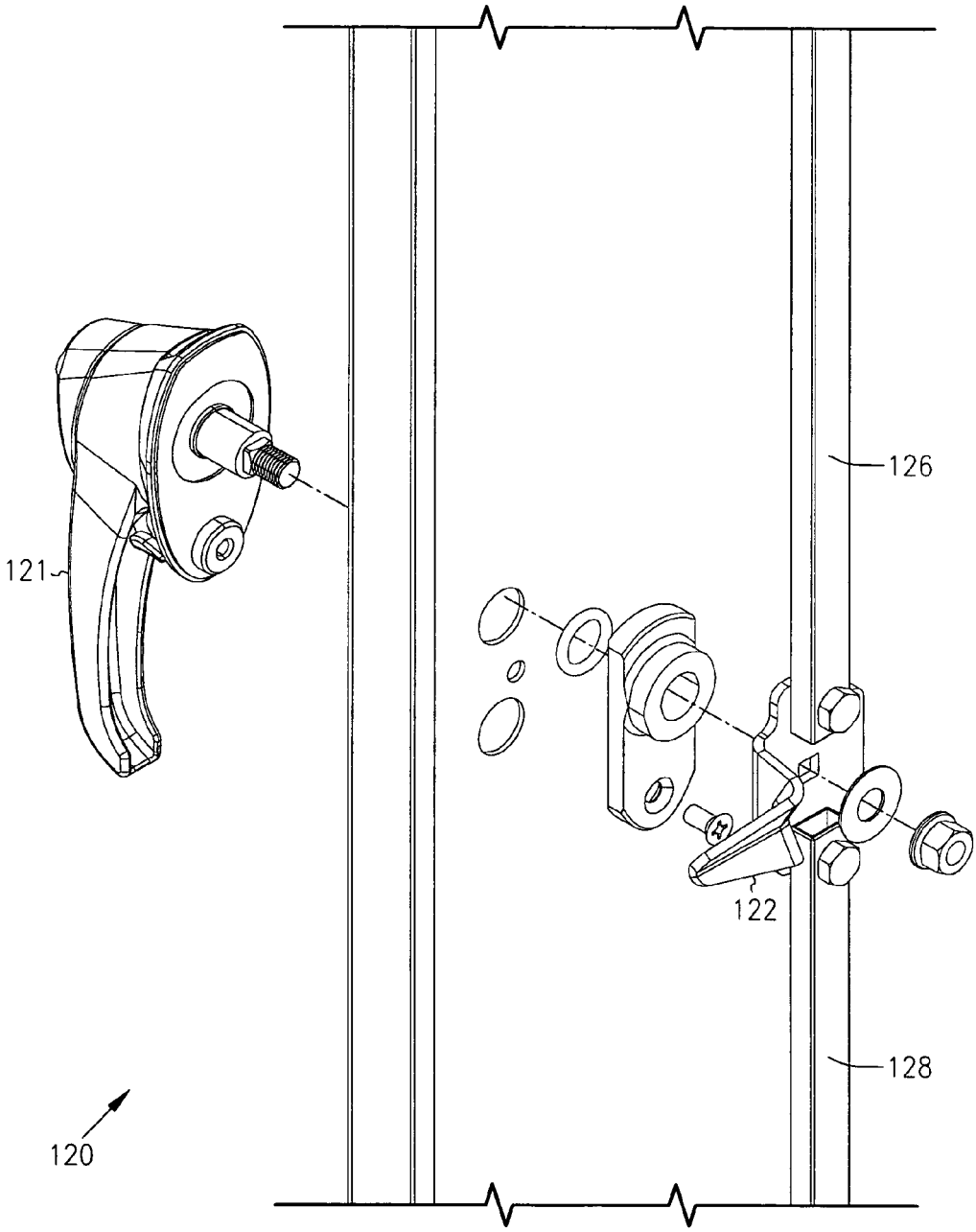
FIG. 1B shows an exploded view of a door latch assembly of the enclosure of FIG. 1A.

FIGS. 1A-1B show a multi-door enclosure 100 according to one embodiment. Enclosure 100 includes an enclosure body or housing 110 having a primary door 112 and a secondary door 114. Enclosure 100 is for holding electrical equipment. Doors 112 and 114 are attached to housing 110 by hinges 116 and 118 respectively. Each door 112 and 114 includes a conventional door latching assembly 120. Referring to FIG. 1B, door latching assembly 120 is actuated by turning a handle 121 which in turn rotates a latch 122 which engages side flange 124 of housing 100. A pair of vertically translating members 126 and 128 are also actuated by handle 121 and translate to engage top and bottom portions 130 and 132, respectively, of housing 100.

Enclosure 100 is designed such that secondary door 114 cannot be opened unless primary door 112 is open. In other words, if primary door 112 is closed, secondary door 114 will be unopenable.

In one embodiment, enclosure 100 includes an interlock assembly 140 which is configured to prevent secondary door 114 from being opened unless primary door 112 is opened first. In one embodiment, interlock assembly 140 includes an actuating member 142, an interlock member 146, and a latch assembly 148. Interlock member 146 extends between primary door 112 and secondary door 114 and includes a holding section 150. In this example, interlock member 146 is slidably coupled to an upper portion of enclosure 100 and extends horizontally between door 112 and door 114. As primary door 112 closes, actuator 142 contacts one end of interlock member 146 to translate interlock member 146 horizontally towards secondary door 114 until holding section 150 engages latch assembly 148 on secondary door 114. This prevents secondary door 114 from being opened.

Actuator 142 can include a rigid, planar plate structure extending generally perpendicularly from the inside surface of primary door 112. In one embodiment, actuator 142 can be proximate a hinged side of primary door 112.

Figure 2:
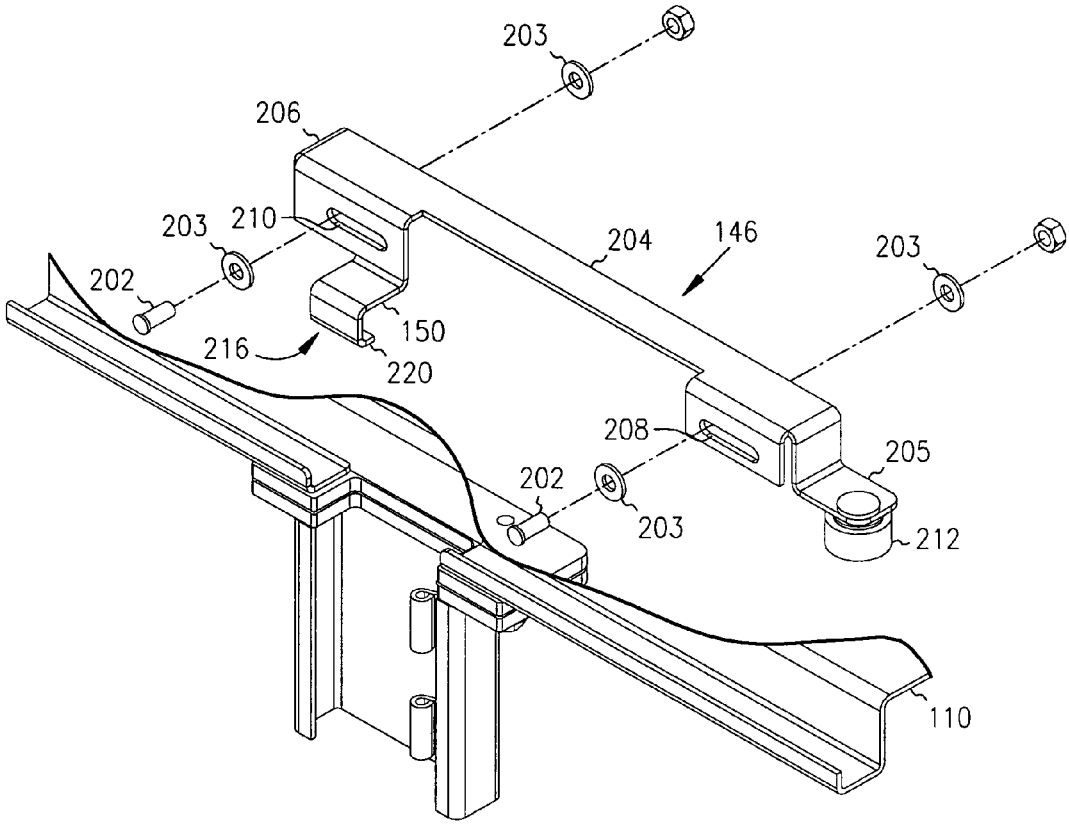
FIG. 2 shows a perspective view of an interlock member according to one embodiment.

FIG. 2 shows further details of interlock member 146, in accordance with one embodiment. Interlock member 146 is mounted to housing 110 by one or more fasteners 202, for example. Interlock member 146 includes an elongate rigid main body portion 204, formed of steel or aluminum for example, which extends from a first end 205 to a second end 206. A pair of slots 208 and 210 extend longitudinally along portions of the first and second ends, respectively, of the interlock member. Fasteners 202 mount the interlock member to the housing such that the interlock member slides freely back and forth relative to housing 110 via slots 208 and 210. In one embodiment, nylon washers 203 can be provided to decrease friction.

In one embodiment, interlock member 146 includes a roller bearing 212 on first end 205. Roller bearing 212 is contacted by actuator 142 (FIG. 1) when the primary door is closing to cause interlock member to translate towards the secondary door. In one embodiment, interlock member 146 includes holding section 150 on second end 206. In this example, holding section 150 includes a U-shaped projection 216 extending from main body 204. A lower projecting section 220 is adapted to engage latch assembly 148 (FIG. 1) when the primary door is closed and interlock member 146 has been translated towards the secondary door. This holds the secondary door closed and the secondary door cannot be opened until the interlock member moves back towards the primary door.

Figure 3:
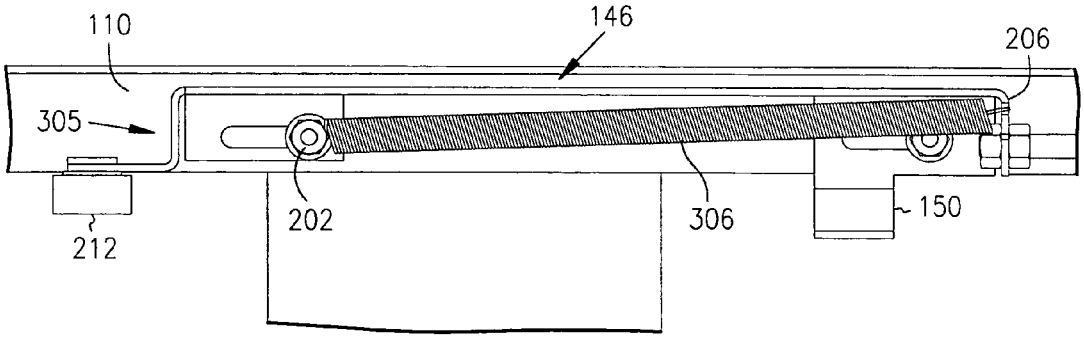
FIG. 3 shows a back view of the interlock member of FIG. 2.

FIG. 3 shows an inside, back view of interlock member 146 mounted to enclosure housing 110. Interlock member 146 fits within a very small space 305 at the upper portion of the housing. This small footprint height-wise allows for the interlock assembly to be used in low-profile enclosures. For example, in one embodiment space 305 has a height of approximately 1⅜ inches. In one embodiment, a biasing member such as a spring 306 is mounted between fastener 202 and second end 206 of interlock member 146. Spring 306 provides a force to bias the interlock member back towards the primary door to automatically un-latch the secondary door from holding section 150 when the primary door is opened. Then, as the primary door is closed, the actuator on the primary door contacts bearing 212 to move the interlock towards the secondary door, where holding section 150 then engages the secondary door. When the primary door is opened, spring 306 forces or biases the interlock member back towards the primary door.

Figure 4:
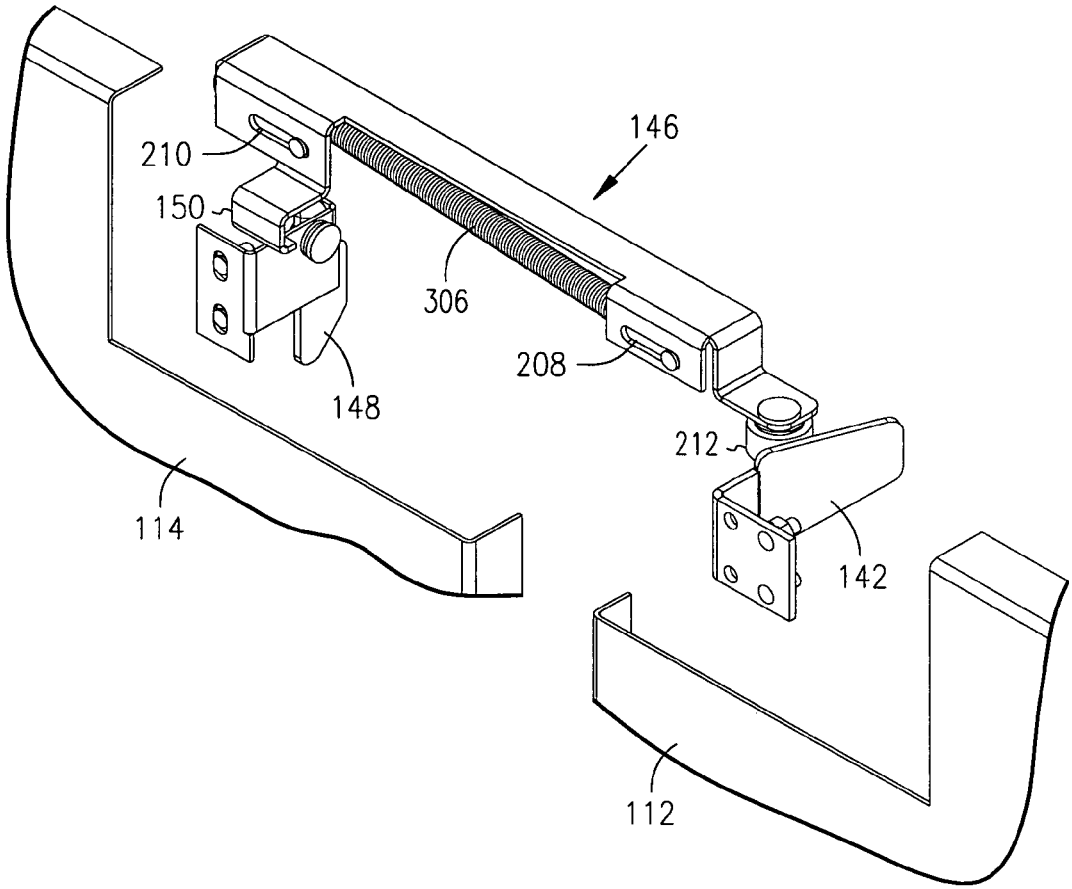
FIG. 4 shows a perspective view of an interlock assembly according to one embodiment.

FIG. 4 shows further details of the interaction between actuating member 142, interlock member 146, holding section 150, and latch assembly 148. Actuator 142 holds interlock member 146 so that holding section 150 is latched to latch assembly 148. When primary door 112 is rotated open, actuator 142 also moves away from interlock member 146. Spring 306 pulls the interlock member, via slots 208 and 210 towards the primary door so that holding section 150 no longer engages latch assembly 148. This allows the secondary door to be opened. In some embodiments, latch assembly 148 can be located on interlock member 146 and holding section 150 can be located on the secondary door 114.

Figure 5A:
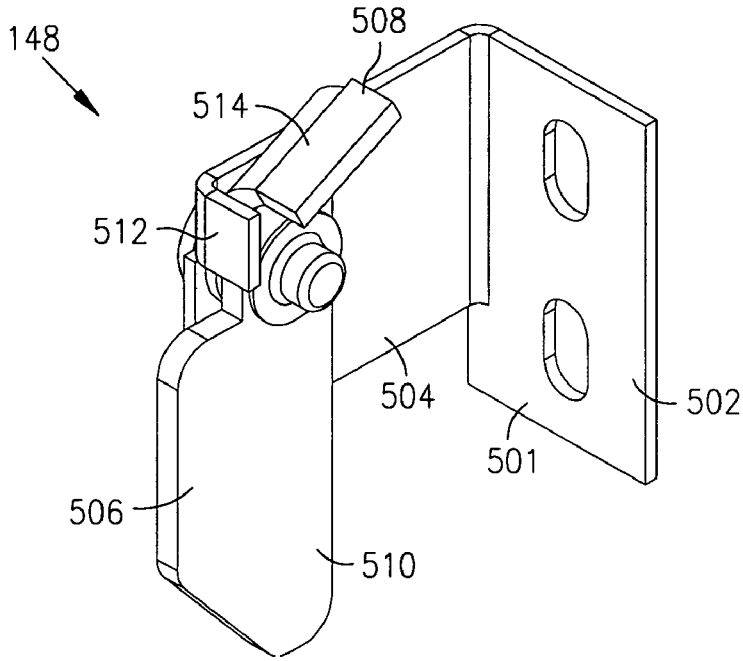
FIG. 5A shows a perspective view of a latch assembly of the interlock assembly of FIG. 4.

FIG. 5A shows details of latch assembly 148, according to one embodiment. Latch assembly 148 includes a body 501 including a mounting portion 502 to mount the latch assembly to the secondary door of the enclosure. A section 504 perpendicularly extends from mounting portion 502. Latch member 506 is rotatably coupled to section 504. In one embodiment, latch member 506 includes an upper latching portion 508 and a lower, weighted portion 510. A projection 512 keeps latch member from rotating any further counterclockwise (relative to FIG. 5A) than vertical. Holding section 150 (FIG. 4) engages upper latching portion 508. Upper surface 514 of upper portion 508 includes a camming surface. This allows the secondary door to be closed and latched if the primary door is closed first. For example, if the primary door is closed and interlock member 146 (FIG. 4) has been translated over towards the secondary door, then camming surface 514 will contact holding section 150 as the secondary door is being closed. This will rotate latch member clockwise (relative to FIG. 5A) and latch member 506 will slide under holding section 150. Once camming surface 514 has passed the holding section, weighted portion 510 will rotate the latch member counterclockwise to a vertical position where the latch member 506 will then be held by holding section 150, and thus not allowing the secondary door to be opened.

Figure 5B:
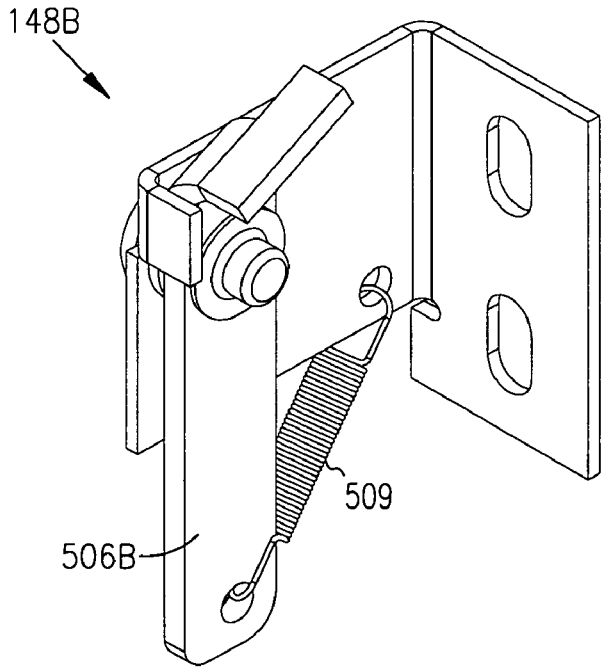
FIG. 5B shows a perspective view of a latch assembly according to one embodiment.

Some embodiments can use a spring or other biasing member in place of, or in addition to, weighted portion 510 to bias the latch member 506 to a vertical orientation. For example, FIG. 5B shows a latch assembly 148B with a biasing member, such as a spring 509, to bias a latch member 506B.

The present system can be adapted to be used for three, four or more door multi-door enclosures.

Figure 6A:
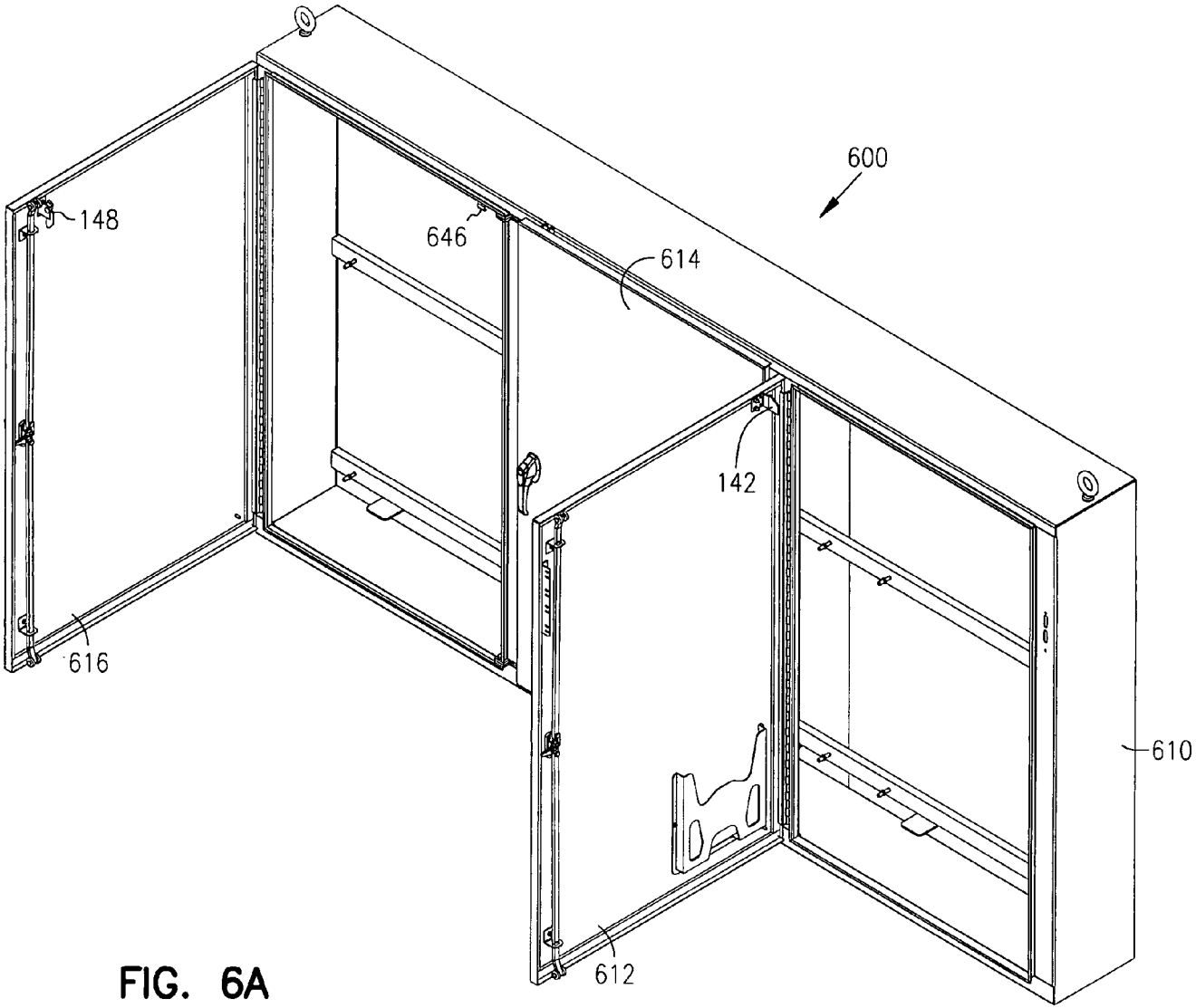
FIG. 6A shows a perspective view of a multi-door enclosure according to one embodiment.

FIG. 6A shows a three door multi-door enclosure 600, in accordance with one embodiment. Enclosure 600 includes a housing 610 having three doors 612, 614, and 616 hingedly connected to a front of the housing. Door 612 is a primary door and includes an actuating member 142, as discussed above. Secondary doors 614 and 616 each include latch assembly 148 mounted to an inner surface of the doors. Enclosure 600 includes an interlock assembly which includes an interlock member 646 which extends between primary door 612, across secondary door 614, and to secondary door 616.

Figure 6B:
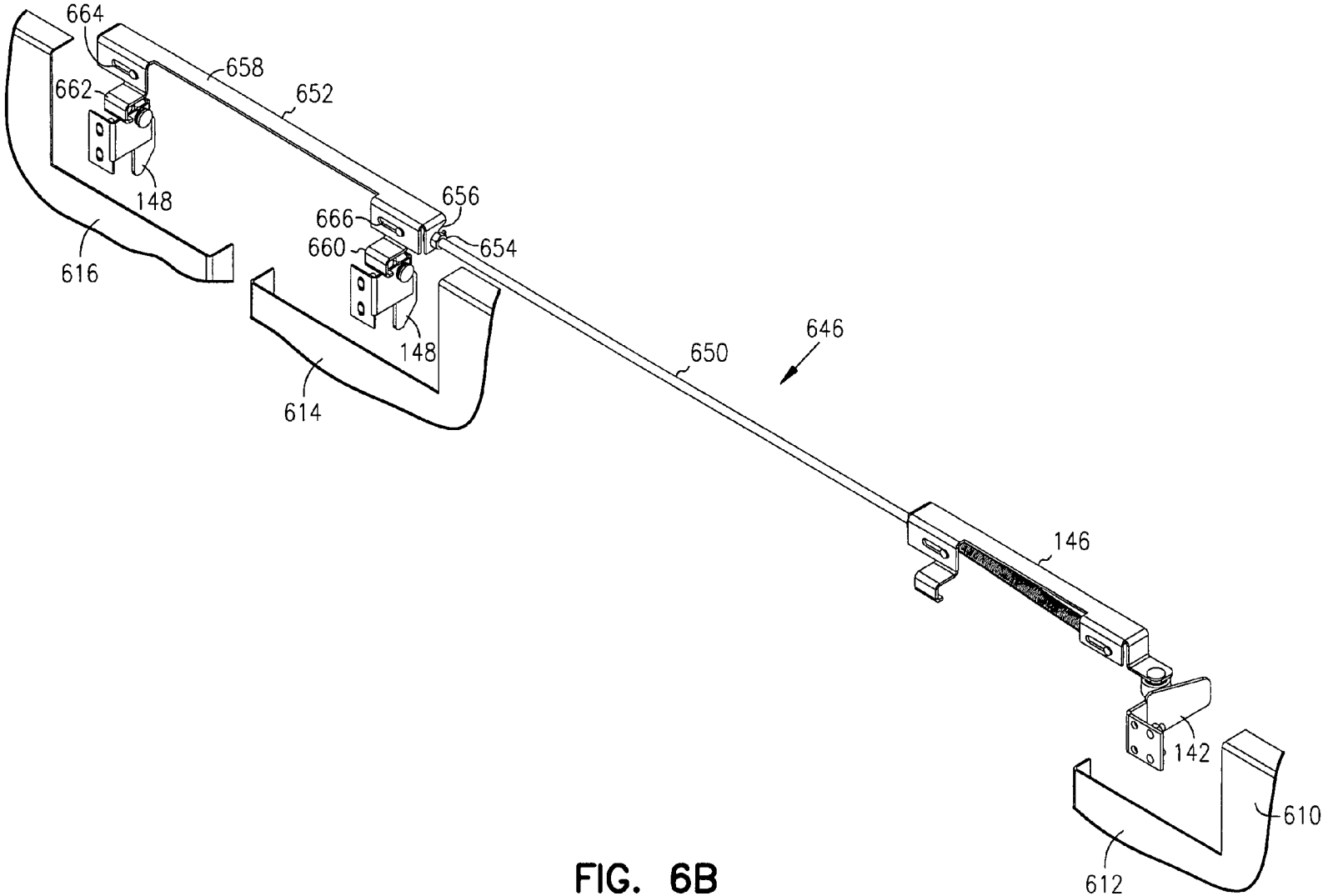
FIG. 6B shows an embodiment of an interlock assembly for the enclosure of FIG. 6A.

FIG. 6B shows further details of interlock member 646, according to one embodiment. Interlock member 646 includes a first interlock member 146 as discussed above. A second interlock member 652 is coupled to interlock member 146 by a rigid coupling shaft 650. Interlock member 146, coupling shaft 650 and second interlock member 652, in combination, form the interlock member 646 for a three door enclosure. Second interlock member 652 includes an elongate, rigid body 658 slidably mountable to housing 610 in a similar manner as interlock member 146, discussed above. Second interlock member 652 includes a slot 656 on one end for coupling to coupling shaft 650. In this example, a pair of bolts 654 are located on either side of slot 656 to hold the coupling shaft within slot 656. Second interlock member 652 includes a pair of holding sections 660 and 662 proximate the respective ends of the interlock member 652. Holding sections 660, 662 engage latch members 148 in the manner described above.

Figure 7A:
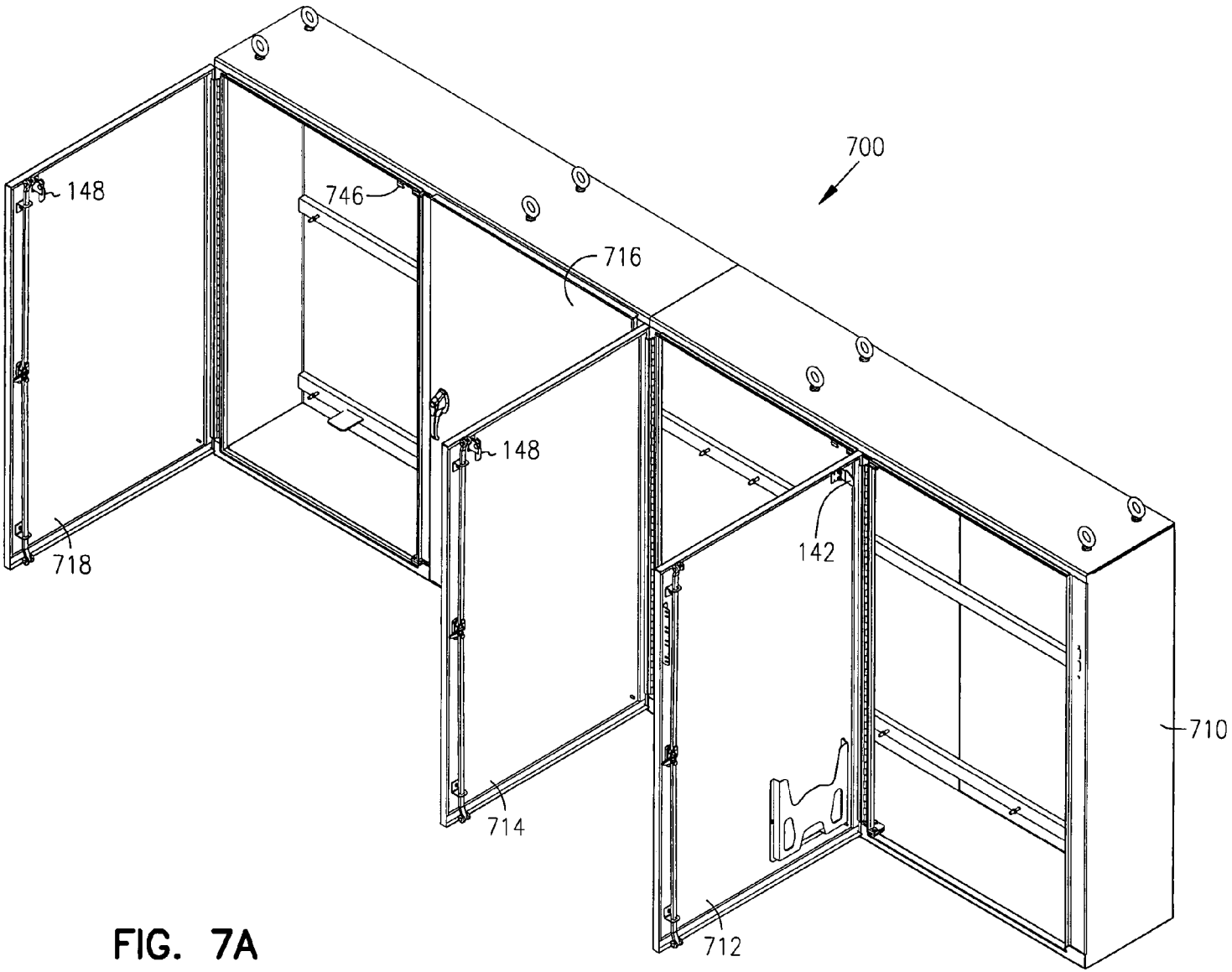
FIG. 7A shows a perspective view of a multi-door enclosure according to one embodiment.
Figure 7B:
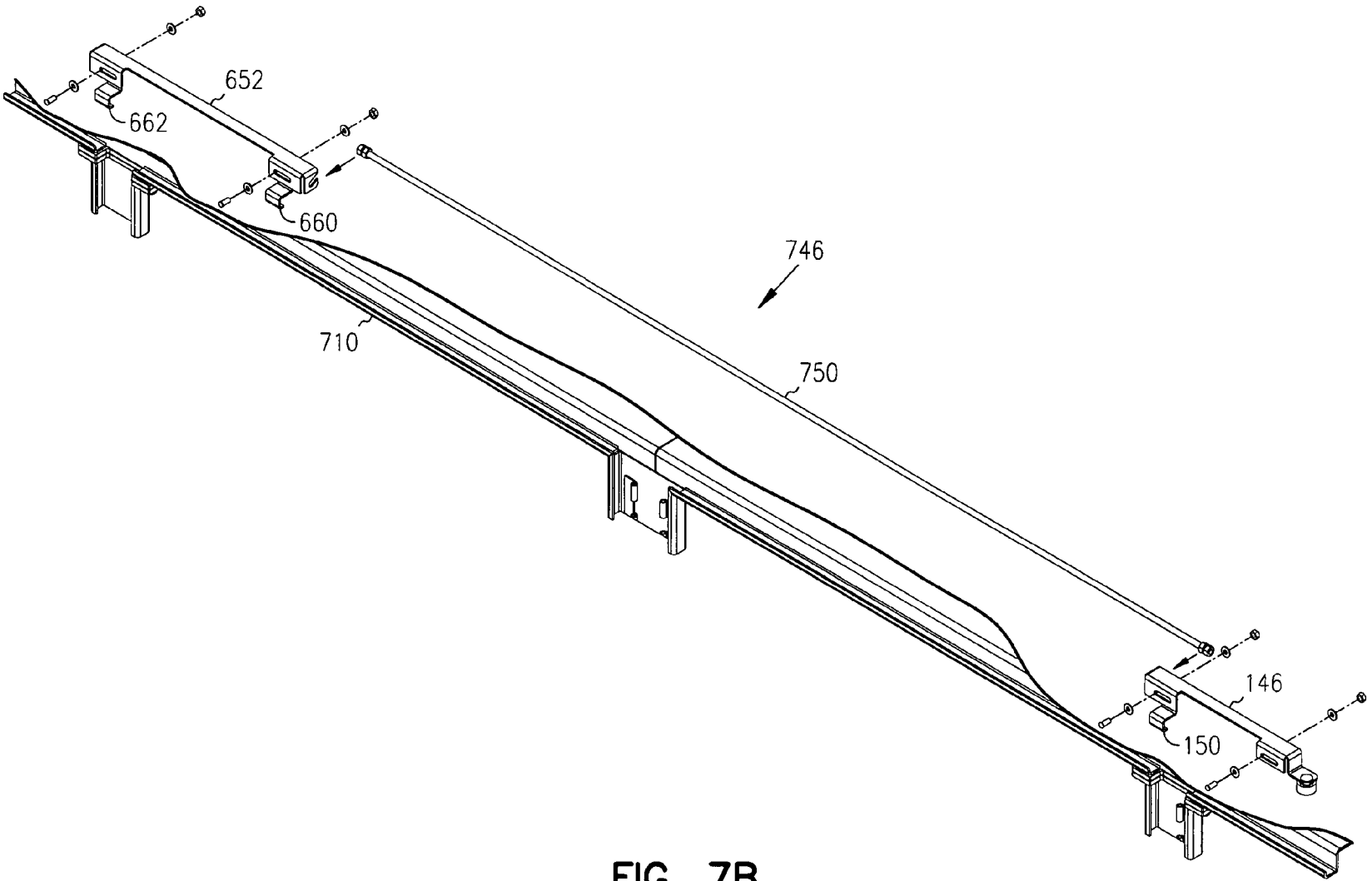
FIG. 7B shows an embodiment of an interlock assembly for the enclosure of FIG. 7A.

FIGS. 7A and 7B show a four door enclosure 700 according to one embodiment. Enclosure 700 includes a housing 710 and four doors 712, 714, 716, and 718, similar to the doors described above. Primary door 712 includes an actuator 142 coupled to an upper portion of the inside of the door and positioned proximate the hinged side of door 712. Actuator 142 contacts an interlock member 746 which translates horizontally towards the secondary doors 714, 716, and 718 to engage latch members 148 located on an upper portion of those doors. Referring to FIG. 7B, in this example, interlock member 746 includes a first interlock member 146 and a second interlock member 652 coupled by an elongate, rigid coupling shaft 750. Holding sections or members 150, 660, and 662 engage the latch assemblies 148 of the secondary doors.

Figure 8A:
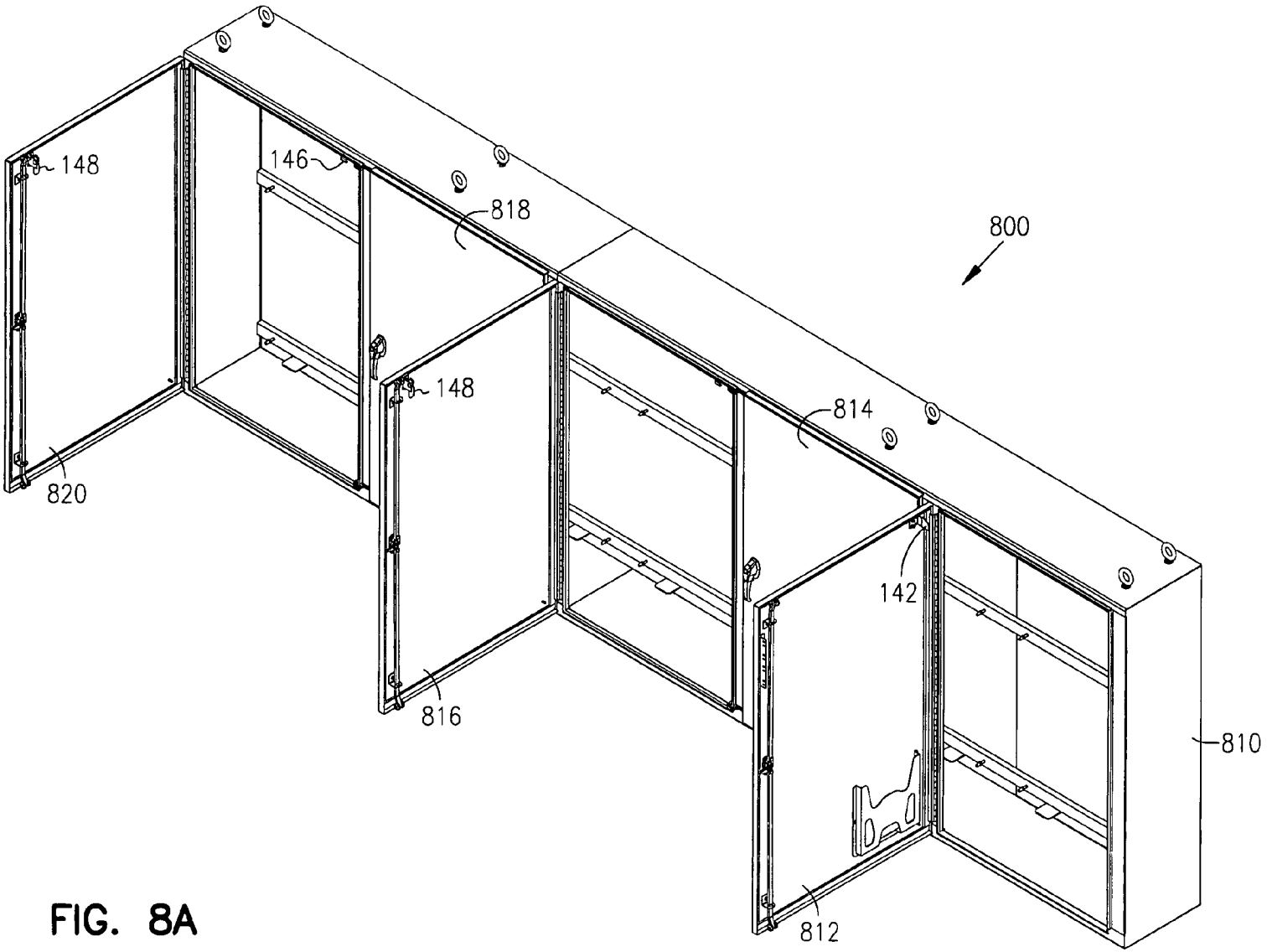
FIG. 8A shows a perspective view of a multi-door enclosure according to one embodiment.
Figure 8B:
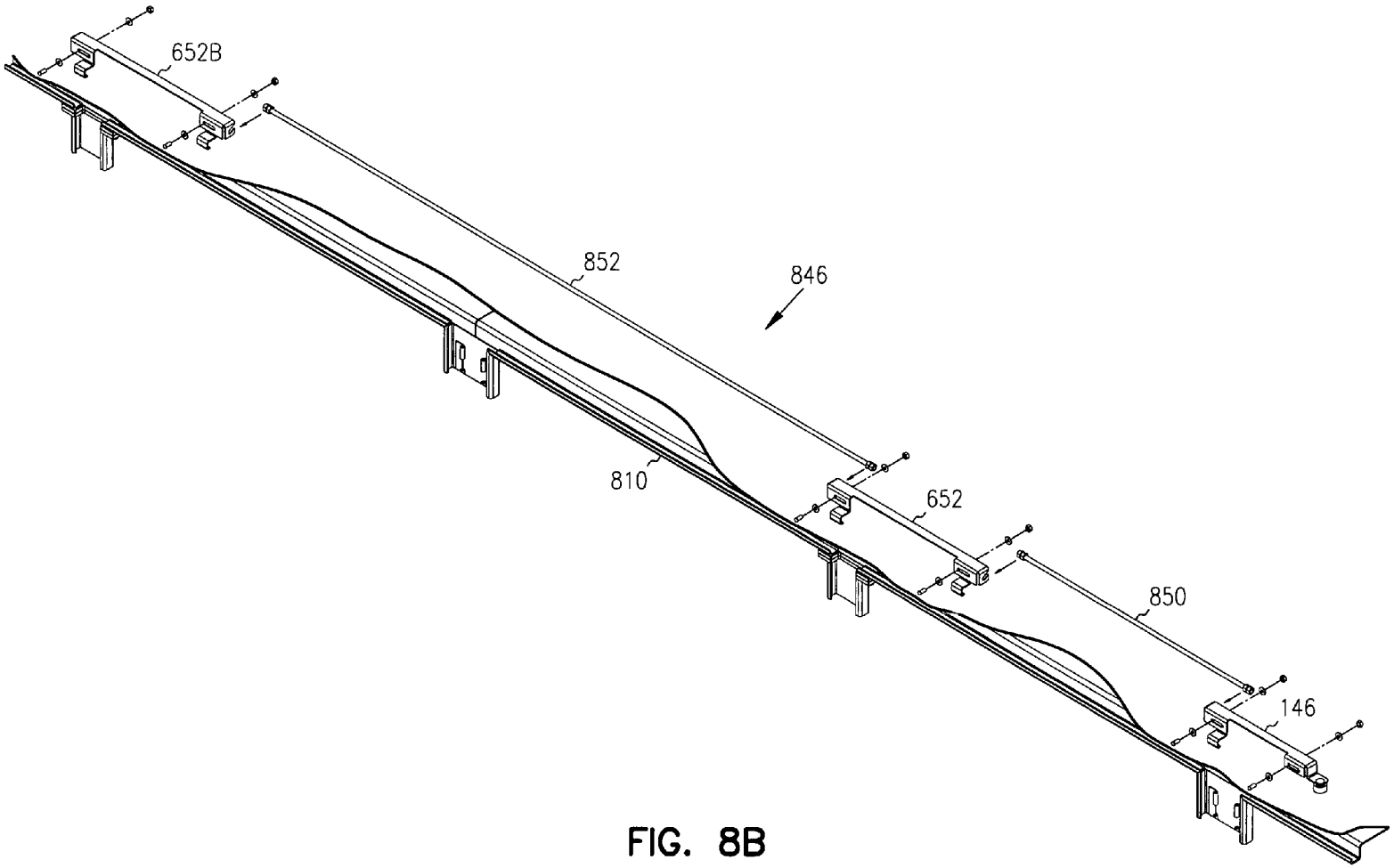
FIG. 8B shows an embodiment of an interlock assembly for the enclosure of FIG. 8A.

FIGS. 8A and 8B show a five door enclosure 800 according to one embodiment. Enclosure 800 includes a housing 810 and five doors 812, 814, 816, 818, and 820, similar to the doors described above. Primary door 812 includes an actuator 142 coupled to an upper portion of the inside of the door and positioned proximate the hinged side of door 812. Actuator 142 contacts an interlock member 846 which translates horizontally towards the secondary doors 814, 816, 818, and 820 to engage latch members 148 located on an upper portion of those doors. Referring to FIG. 8B, in this example, interlock member 846 includes a first interlock member 146 coupled by a rigid coupling shaft 850 to a second interlock member 652 which is coupled by an elongate, rigid coupling shaft 852 to a third interlock member 652B.

Figure 9:
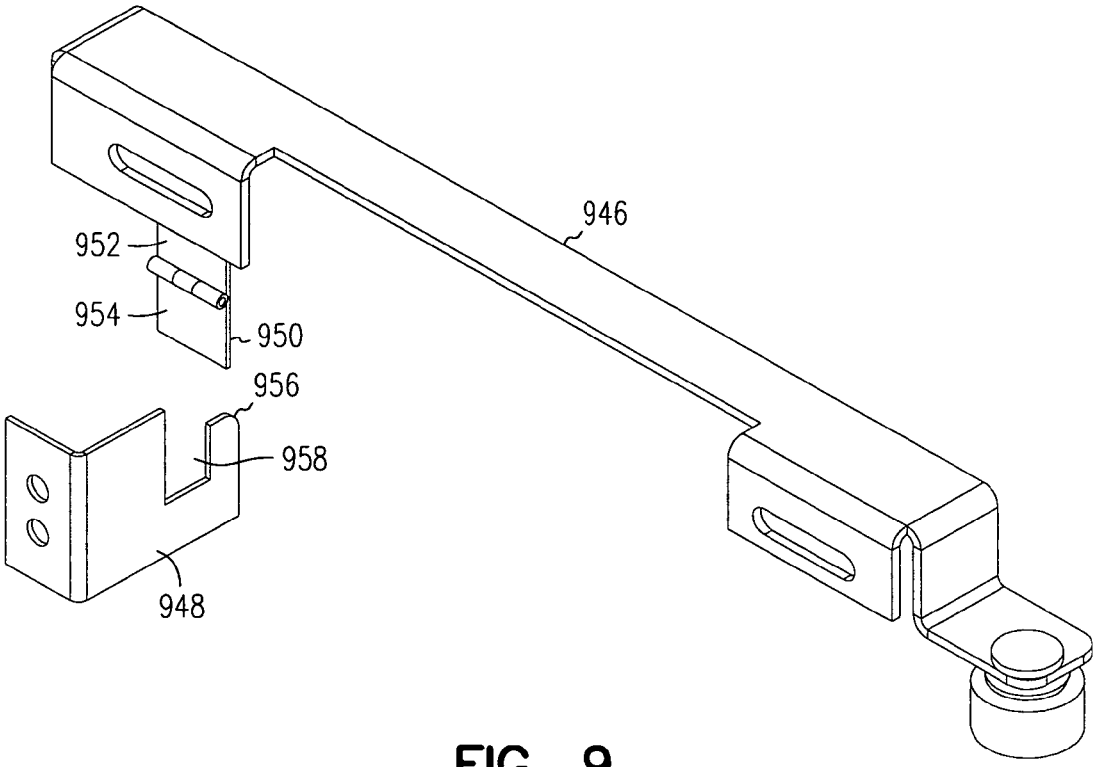
FIG. 9 shows a perspective view of an interlock member according to one embodiment.

FIG. 9 shows a perspective view of an interlock member 946, in accordance with one embodiment. Interlock member 946 performs in generally the same manner as interlock member 146 (FIG. 2), discussed above, and the above discussion is incorporated herein. Interlock member 946 is mounted to enclosure housing, such as housing 110, discussed above. A holding section 950 on an end of the interlock member is adapted to engage a latch assembly 948 mounted to a secondary door of the enclosure.

In this embodiment, holding section 950 includes an upper section 952 mounted to the interlock member body and a lower section 954 which is rotatably attached to upper section 952. Holding section 950 is designed like a hinge in that the lower section 954 can swing inward but cannot swing outward. Thus, as the secondary door is closing, a lip 956 on latch assembly 948 rotates lower section 954 upward until lip 956 passes and then lower section 954 falls into a cut-out 958 of the latch assembly 948. Someone trying to open the secondary door would then not be able to since the lower section 954 cannot rotate outward. To open the secondary door, the interlock member 946 is translated away from the secondary door, as discussed above, and holding section 950 moves out of cut-out 958. The example interlock member of FIG. 9 can be used in place of, or in addition, to any of the embodiments discussed above.

Thus, using only a few simple members, the present system provides an interlock assembly and system which can be used for many different size multi-door enclosures. In some embodiments, by latching the interlock member directly to the secondary door, instead of trying to control the handle latch mechanism of the secondary door, a slim, easy to manufacture and easy to assemble interlock design is provided. In some embodiments, by utilizing a horizontally translating interlock member, the present interlock assembly can fit within small, low-profile enclosures.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A multi-door enclosure comprising:

an enclosure housing;

a primary door attached to the enclosure housing, the primary door having an actuator;

a secondary door attached to the enclosure housing;

an interlock member extending between the primary door and the secondary door, the interlock member including a holding section, the interlock member including an elongate rigid main body portion with a pair of slots through which fasteners mount the interlock member to the enclosure housing, the interlock member being a single component including the holding section, the elongate rigid main body portion, and the pair of slots for use in low-profile enclosures, the interlock member extending horizontally between the primary door and the secondary door; and a biasing member coupled to the interlock member;

the actuator and the interlock member being configured such that, as the primary door closes, the actuator of the primary door contacts the interlock member to horizontally translate the interlock member towards the secondary door until the holding section engages the secondary door to prevent the secondary door from being opened;

the secondary door being allowed to close when the primary door is both open and closed and opening the primary door biases the interlock member towards the primary door.

2. The multi-door enclosure of claim 1, wherein the actuator is located proximate a hinged side of the primary door.

3. The multi-door enclosure of claim 1, wherein the actuator includes a rigid plate extending from an inner surface of the primary door and positioned so as to contact an end of the interlock member when the primary door is closed.

4. The multi-door enclosure of claim 1, wherein the interlock member is translatable in a horizontal direction between the primary door and the secondary door.

5. The multi-door enclosure of claim 1, wherein the secondary door includes a latch assembly to engage the holding section of the interlock member.

6. The multi-door enclosure of claim 5, wherein the latch assembly includes a body mounted to the secondary door and a latch member mounted to and rotatably coupled to the body.

7. A multi-door enclosure comprising:

an enclosure housing;

a primary door attached to the enclosure housing, the primary door having an actuator;

a secondary door attached to the enclosure housing;

an interlock member extending between the primary door and the secondary door, the interlock member including a holding section, the interlock member including an elongate rigid main body portion with a pair of slots through which fasteners mount the interlock member to the enclosure housing, the interlock member extending horizontally between the primary door and the secondary door; and a biasing member coupled to the interlock member;

the actuator and the interlock member being configured such that, as the primary door closes, the actuator of the primary door contacts the interlock member to horizontally translate the interlock member towards the secondary door until the holding section engages the secondary door to prevent the secondary door from being opened, the secondary door being allowed to close when the primary door is both open and closed, and opening the primary door biases the interlock member towards the primary door.

8. A multi-door enclosure comprising:

an enclosure housing;

a primary door attached to the enclosure housing, the primary door having an actuator;

a secondary door attached to the enclosure housing and configured to assume a fully closed position when seated flush with a front face of the enclosure housing; and an interlock member extending between the primary door and the secondary door, the interlock member including a holding section, the interlock member including an elongate rigid main body portion with a pair of slots through which fasteners mount the interlock member to the enclosure housing, the interlock member extending horizontally between the primary door and the secondary door;

the actuator and the interlock member being configured such that, as the primary door closes, the actuator of the primary door contacts the interlock member to horizontally translate the interlock member towards the secondary door until the holding section engages the secondary door to prevent the secondary door from being opened;

the secondary door able to achieve the fully closed position when the primary door is both open and closed.

* * * * *